United States Patent [19]

Hurst

[11] Patent Number: 4,720,110

[45] Date of Patent: Jan. 19, 1988

[54] GOLF CLUB AND SIGHTING ATTACHMENT THEREFOR

[76] Inventor: John M. Hurst, 30 St. James Rd., Shrewsbury, Mass. 01545

[21] Appl. No.: 908,735

[22] Filed: Sep. 18, 1986

[51] Int. Cl.[4] ..... A63B 69/36

[52] U.S. Cl. ..... 273/183 D; 273/186 A; 273/163 R

[58] Field of Search ..... 273/163 R, 163 A, 183 D, 273/164, 186 A

[56] References Cited

U.S. PATENT DOCUMENTS 2,898,109 8/1959 Williams ..... 273/163 R
3,198,525 8/1965 Smith ..... 273/163 A
3,529,830 9/1970 Palotsee ..... 273/163 R
4,174,838 11/1979 Paschetto ..... 273/163 A

*Primary Examiner*—George J. Marlo

[57] ABSTRACT

A golfer's visual aid in lining the proposed ball path and improving the stance, while being small, light, and inexpensive, and instantly applicable to and removable from the head of a golf club. An elongated attachment has a longitudinally adjustable pin at one end and a magnet at the other end to removably secure it to a golf club head. The pin indicates the line of flight of the next stroke. The attachment holds the pin a significant distance above the club head to indicate correct stance of the player by the obstruction of a mark on the club head.

13 Claims, 12 Drawing Figures

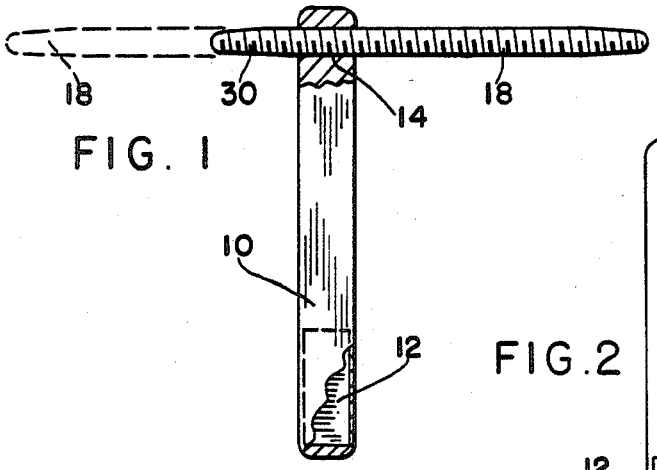
FIG. 1
FIG. 2
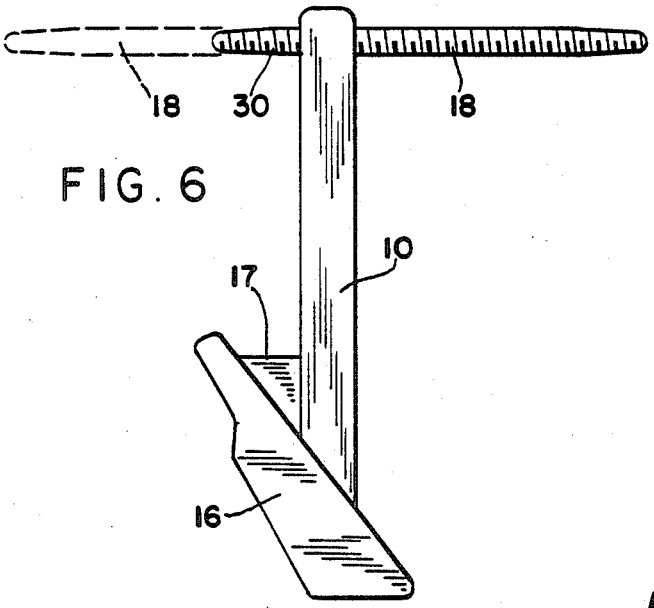
FIG. 6
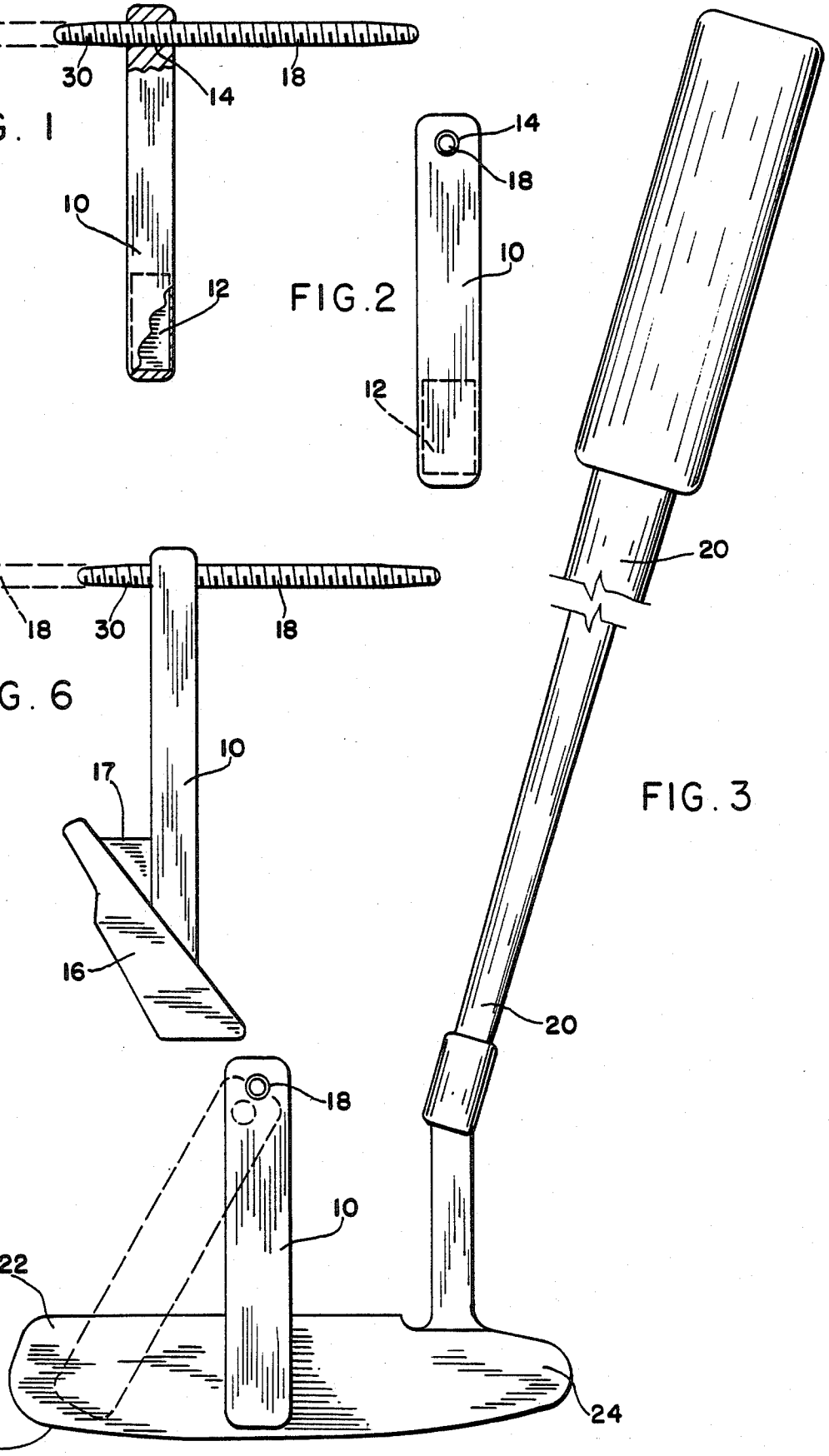
FIG. 3

FIG. 7
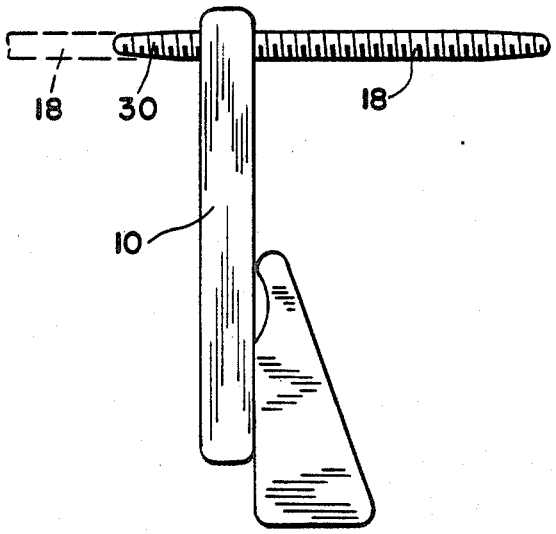
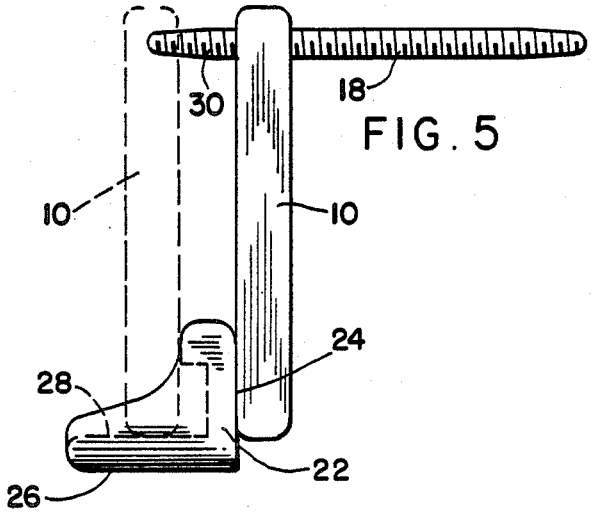
FIG. 5
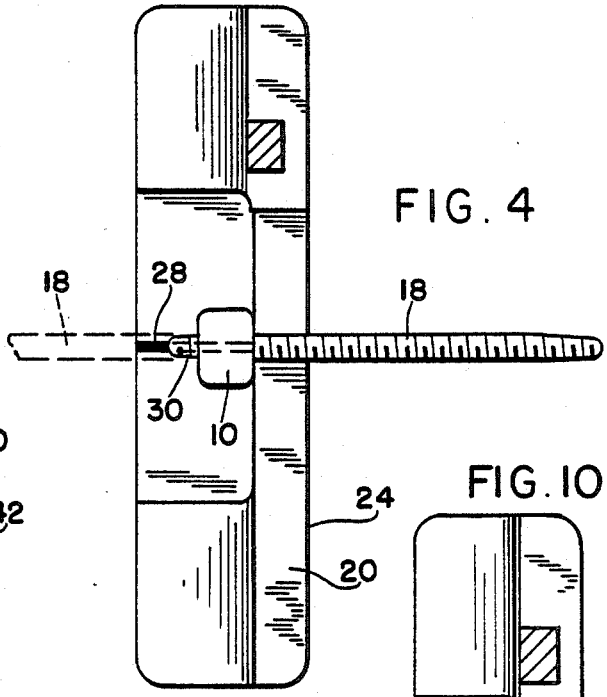
FIG. 4
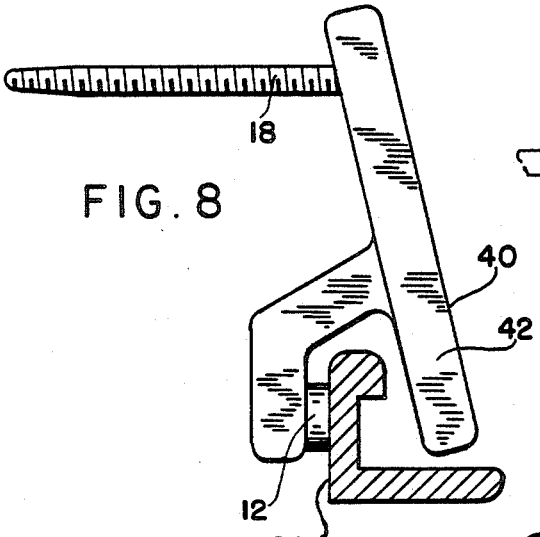
FIG. 8
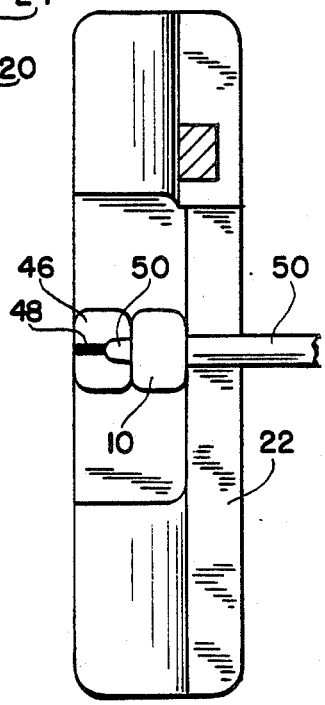
FIG. 10
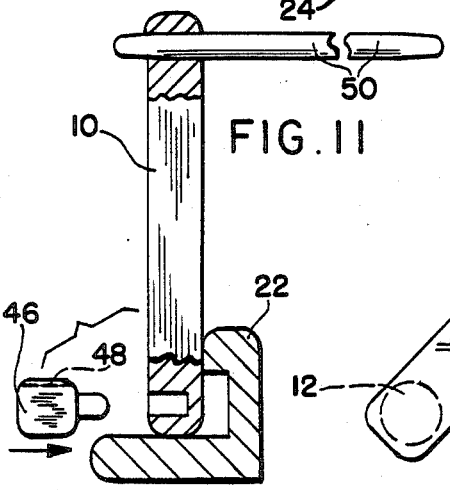
FIG. 11
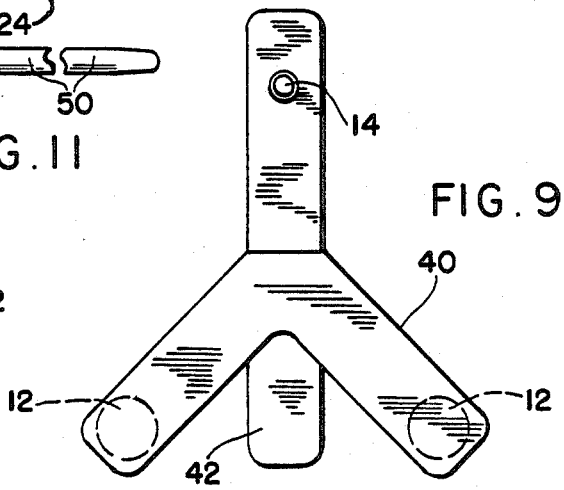
FIG. 9

GOLF CLUB AND SIGHTING ATTACHMENT THEREFOR

FIELD OF THE INVENTION

This invention relates to a device to improve a golfer's line of flight and stance.

BACKGROUND OF THE INVENTION

There are many golf professionals who teach the game. Most golfers take lessons from the pros from time to time but practice far longer than the time used for actual lessons. Anything that can improve their game is well worth while to most golfers, especially anything that actually improves the game, as opposed to merely practicing what can be remembered of the lessons.

Many devices have been proposed but most are complicated, difficult to utilize, and ineffective, and it is the object of this invention to provide a small, inexpensive, and easily used device to improve the line of flight or putting direction and to improve the stance, thereby improving the swing and the quality of the game.

SUMMARY OF THE INVENTION

The device itself is extremely simple comprising a generally rectangular member of any suitable material, e.g., plastic that is provided with a magnet at one end to attach it to the steel head of the club, and a hole adjacent the other end to receive a pointer or pin, again preferably of plastic. This pointer or pin extends generally at a right angle to the member having the magnet and is parallel to the direction of the force or attraction of the magnet. Thus, with the member on the club head and extending for instance vertically, the pointer or pin will point out the correct line of flight or of the putt, if the club head surface to which the member is attached is faced correctly, i.e., normal to the direction the ball is to go. This is aided by the fact that the pointer or pin is above the club end and is arranged to extend through the member and is visible to the golfer at the side of the member opposite the main extent of the pointer or pin and can be aligned, vertically, with a mark or indentation at the center of the club head. With such alignment, the stance is perfected, and the hands are located optimately relative to the ball, with the club head sole flat with respect to the ground. A better stroke is thereby assured. While putting is probably the stroke that is thereby most improved, all steel head clubs can be used with this invention and improvement in all strokes is to be had.

Due to the fact that the attachment is applicable anywhere on the club head, it can be applied off center but with the pointer or pin on center, so that the device can be applied to the striking face of a club and the club can still be used to impel the ball in the usual manner.

BRIEF DESCRIPTION OF THE DRAWINGS

FIG. 1 is a side elevational view of the novel attachment, parts broken away and in section;

FIG. 2 is a front elevational view of the attachment;

FIG. 3 is an elevational view of the attachment mounted on the head or blade of a putter;

FIG. 4 is a plan view of the head or blade of a putter with the attachment;

FIG. 5 is an end elevational view of a golf club head with the attachment thereon;

FIG. 6 is a view similar to FIG. 5 but showing a modification applied to a golf club head having considerable loft;

FIG. 7 is a view similar to FIG. 5 but showing the attachment at the surface of a golf club head having some loft, but less than the head of FIG. 6;

FIGS. 8 to 11 show modifications, and

PREFERRED EMBODIMENTS OF THE INVENTION

Figure 12:
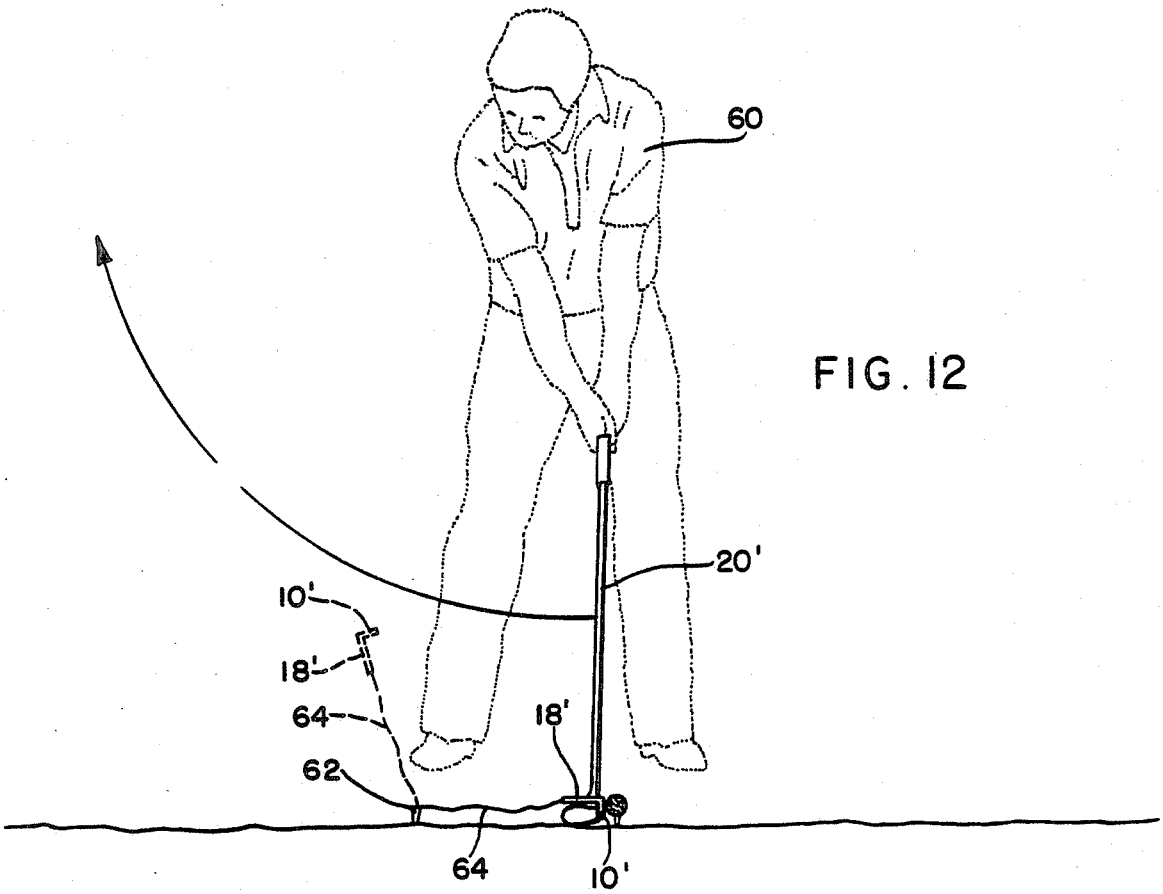
FIG. 12 is a view illustrating the separation of the attachment from the club head, on the back swing.

FIGS. 1 and 2 show the actual novel device that embodies the golfers' aid, which is primarily used for practice, but can be used to line up the putt direction or flight of the ball, and then removed to make the shot, or in some cases, left on the club head, as will appear more fully hereinafter. The clubs are all conventional, and while certain club head-device combinations are made, the device is solely magnetically head to the golf club head and is easily applied and removed.

A relatively thin rectangular bar or rod-like member 10, preferably made of plastic, has applied thereto magnet qualities by which means it is to be applied to a golf club head or blade. The entire member could be magnetized, as with closely interspersed magnets or magnetic discrete material, but it is preferred that a magnet 12 of suitable size and power to be embedded in one end portion of the member 10, with a threaded hole 14 at the opposite end. The member 10 may take any suitable shape, size, and dimension, but as an example, which has been very successfully used, the member 10 may be about $3'' \times \frac{1}{2}''$ and $\frac{3}{8}''$ thick, with the magnet of a size and shape relative thereto as shown in FIGS. 1 and 2. The sides of member 10 are all shown flat, as providing the greatest usage for the invention, but other forms can be used as desired, and reference is made to FIG. 6, wherein a wedge 16 having loft, can be supplied with a corresponding wedge-like shape as at 17, for the device, so that the member 10 will be substantially vertical, as this position of the device is the best for the purpose.

A pointer or pin 18 is threaded and tapered down at the ends thereof for easy application at either end to the threaded hole at either side of the member, and this is indicated in dotted lines in FIGS. 4, 6, and 7.

FIG. 3 shows a putter 20 having a head or blade 22 with a striking face 24, sole 26, and any other conventional faces or shapes. There are many shapes and types of putters, but that shown here is sufficient to explain the invention. However, the upper face of the putter, or other head, is provided with a halfway or center mark 28, FIG. 4, which may be indented or merely marked. This line also shows the ball's projected path but is too short to be of use for this purpsoe. The member 10 is shown in solid lines in FIG. 3 as magnetically mounted on the striking face, 24 centrally of the blades and vertical, the pointer being located at the top portion of the member 10, and extending toward the target, as shown in solid lines in FIG. 5, or oppositely, as in dotted lines in FIG. 4. Either way, the like of the ball is indicated to the golfer, with the blade at a right angle to the ball's projected path.

The member 10 may be applied to the striking face; or to the rear thereof, as in FIG. 4 and in dotted lines in FIG. 5, but either way the pointer points as desired, front or rear, and the flight path is shown. When the pointer extends to the rear, i.e., opposite the path of the ball, it will obscure the mark 28, if the golfer is standing correctly. This indicates a correct stance. If the pointer extends to the front, pointing to the golfer's left in this case, a small projection of the pointer end as at 30, overlies the mark 28, to show the same thing. Therefore, if the pointer shows the ball path and the end 30 (or the pointer itself) overlies the mark 28, the optimum conditions exist to stroke the ball. If the member 10 is at the rear, as in FIG. 4, it need not be removed prior to the stroke, as it will not interfere. The pointer 18, member 10, and club head mark as at 28 can be present and used for any club, with the part 17 in FIG. 6 for some clubs. With a driving iron, or number 2, 3, or 4 clubs, FIG. 7, the member 10 can be applied to the rear of the blade, and after lining everything up, the golf may swing and strike the ball, but the device will fall off the club head on the down swing prior to impact. This invention is perhaps most proficient in improving putting, but can be used to improve any shot, and after practice with the device attached, actual play may be had without it, as the player will remember its use and see it in his mind's eye. It can also be used to line up the shot, then removed, and the play made.

In some cases, the magnet may be secured by a flexible cord to a fixed peg or strike, so that the device falls off on the back stroke. Some short strokes will not be fast enough to drop off the device on the down swing.

The act of separation of the attachment from the club head on the back swing is shown in FIG. 12. The golfer is indicated at 60 and is about to make the back swing along the line of the curved arrow with his club 20'. The attachment to the club head is indicated at 10' and 18'; and it is tethered by a tie 64 to a peg or the like 62 firmly held in the turf. The attachment will stick to the club head until the latter reaches the point where the attachment is shown in dotted lines. The tie 64 is now out straight and the attachment must be shorn off at this point and fall to the ground while the club completes its travel to the top of the back swing, without the attachment.

Also, as indicated in FIGS. 8 and 9, a device 40, having a reflective face 42 at an angle to the vertical can be magnetically secured to the club head so that mark 28 is reflected and seen to be alligned with the center of face 42, and this ensures correct placement and stance also. In the event that a club has not got a mark as at 28, an attachment 46 magnetic or mechanical as shown in FIG. 11 may be applied to the club head or the member 10, as shown in FIGS. 10 and 11. This attachment may have a mark 48 to act as does mark 28. Also the pin 50 may be smooth and with a hand-press fit, can be set where desired, lengthwise, to cover all or only a part of the mark to indicate correct stance, as before. If the club head is non-magnetic, a steel washer can adhesively attached to the club head.

The member 10 could be fixed to the club head and not removable, in which case it would appear as in FIG. 4.

I claim:

1. Golfing aid in combination with a golf club having a head with front and rear faces and an upwardly visible center marking on the head, said aid comprising a removable attachment for either face of the head of the golf club, a direction indicating pin extending from the attachment to point to the target of a golf ball to be impelled by the club, the pin being in significantly spaced relation to and above the golf club head and the center marking thereon, and being adapted to align the golfer's eye vertically with the marking when the marking and the pin appear to be aligned to the golfer, so that the golfer is aided in determining the line of flight of the ball and simultaneously is in correct stance with the eye vertically over the marking on the club, the pin being adjustable to partially reveal the center marking in selected position of the pin.

2. The combination of claim 1 including a slanted face on the attachment to generally correspond to the loft of a club head having a loft with the attachment generally vertical.

3. The combination of claim 1 wherein the means to attach the attachment to the golf club head is a magnet.

4. The combination of claim 3 wherein the magnet is of a strength to tend to fall from the golf club head during the downswing of the golf club.

5. The combination of claim 3 wherein the attachment has a hole and the ends of the pin are tapered to aid in applying it to the hole.

6. The combination of claim 3 wherein the attachment is generally rectangular and elongated and the magnet and pin are located in opposite end portions of the attachment.

7. The combination of claim 1 wherein the pin is of moldable and extrudable plastic.

8. The combination of claim 1 wherein the pin is threaded and the attachment has a corresponding pin receiving threaded hole.

9. The golfing combination of claim 1 wherein the club head is non-magnetic and including a magnet adhesively secured thereto, said attachment including a magnet.

10. A golfing aid in combination with a golf club having a head for determining line of flight of a proposed stroke comprising an elongated member having a hole therethrough adjacent one end and a magnet at the other end, the magnet providing for temporary securement of the attachment to a golf club head at any point along the head, a pin in the hole, the pin and the force of the magnet being spaced but parallel, the pin being adjustable in the hole so that the pin may point to the target or in the opposite direction while remaining parallel to the line of flight and the member remaining in original position on the club head.

11. The combination of claim 10 including a connection from the magnet to a fixed point so that the aid is abstracted from the club head on the back swing.

12. The combination of claim 10 including a slant face on the aid, said face being reflective of a center line on the club head.

13. The combination of a golfing aid and a golf club having a head with an upwardly visable mark thereon, said mark being in the line of proposed travel of the ball to be stroked, an elongated direction element, an upright member on the club head mounting said element in vertical alignment with the mark and significantly above and spaced from the mark, said element being lengthwise adjustable to wholly or selectively partially obscure the mark, the element at the same time indicating the desired line of travel of the ball.

* * * * *